US005758611A

United States Patent [19]

Collins

[11] Patent Number: 5,758,611

[45] Date of Patent: Jun. 2, 1998

[54] FLEX-ROD

[76] Inventor: Imack L. Collins, 9329 Castle Brook, Shreveport, La. 71129

[21] Appl. No.: 839,589

[22] Filed: Apr. 15, 1997

[51] Int. Cl.[6] ..... F02B 75/26

[52] U.S. Cl. ..... 123/51 BB; 123/53.5; 123/197.3; 74/579 E

[58] Field of Search ..... 123/197.3, 51 B, 123/51 BB, 52.5, 53.1, 53.5; 74/579 E

[56] References Cited

U.S. PATENT DOCUMENTS

| | | | |
|---|---|---|---|
| 1,470,752 | 10/1923 | Kundsen . | |
| 1,474,591 | 11/1923 | Hounsfield | 123/52.3 |
| 1,777,478 | 10/1930 | Schaeffers . | |
| 1,902,020 | 3/1933 | Ewing . | |
| 2,048,243 | 7/1936 | Zoller . | |
| 2,342,900 | 2/1944 | Sandell . | |
| 2,419,531 | 4/1947 | Bronander | 123/51 BB |
| 3,537,437 | 11/1970 | Paul et al. . | |
| 4,079,705 | 3/1978 | Buchner . | |
| 4,296,714 | 10/1981 | Buchner . | |
| 4,338,892 | 7/1982 | Harshberger | 123/53.5 |
| 5,383,427 | 1/1995 | Tuggle et al. . | |
| 5,617,820 | 4/1997 | Beardmorre et al. | 123/197.3 |

FOREIGN PATENT DOCUMENTS

| | | |
|---|---|---|
| 666349 | 2/1952 | United Kingdom . |
| 730554 | 5/1955 | United Kingdom . |
| WO 95/27129 | 10/1995 | WIPO . |

*Primary Examiner*—David A. Okonsky
*Attorney, Agent, or Firm*—Pearne, Gordon, McCoy & Granger LLP

[57] ABSTRACT

A two-stroke, U-type uniflow engine includes a cylinder block forming parallel first and second cylinders and a common combustion chamber connecting the first and second cylinders. First and second pistons are mounted for reciprocal, linear movement within the first and second cylinders respectively. The engine also includes a crank shaft having a crank pin and a one-piece forked connecting rod connecting each of the first and second pistons to the crank pin. The connecting rod is elastically, bilaterally flexible to accommodate variations between a maximum distance between the first and second pistons and a minimum distance between the first and second pistons and is in a relaxed state half-way between the maximum distance and the minimum distance. The central wall has a slot for passage of the connecting rod therethrough and angled notches which correspond to maximum angles of the connecting rod. The connecting rod is designed to minimize weight and length and the engine bore and stroke are selected to minimize the difference between the maximum and minimum distance of the wrist pin displacement in order to reduce vibrations and to increase engine output by maintaining high crankcase compression.

20 Claims, 7 Drawing Sheets

24
46
22
36
34
54
42
44
52a
114
116
32
28
30

24
46
36
34
22
54
42
44
52a
114
116
32
28
30

24
46
22
44
42
36
34
54
52a
28
114
116
32
30

24
46
22
44
42
36
34
50
54
52a
28
114
116
30
32

FLEX-ROD

BACKGROUND OF THE INVENTION

The present invention generally refers to small-displacement internal combustion engines and, more particularly, to such two-stroke, U-type uniflow engines for powering portable tools.

Small internal combustion engines provide convenience and power to hand-held or portable power tools, particularly lawn and garden equipment such as chain saws, lawn mowers, trimmers, leaf blowers and vacuums, and lawn edgers. Portable power tools are typically powered by two-stroke internal combustion engines which are normally aspirated, crankcase scavenged, air cooled, and spark ignited. These engines provide more power per weight, are less expensive to manufacture and maintain, and are more reliable than comparable four-stroke engines. Additionally, the lubricating system of crankcase scavenged engines is independent of position and handling.

However, two-stroke engines generally burn fuel less efficiently and emit more pollutants than comparable four-stroke engines. This is partly due to the fact that fuel/air mixture is pumped into the cylinder at the same time that exhaust gasses are evacuated from the cylinder. Because of the small loop in the flow of the fuel/air mixture, some of the fresh fuel/air mixture is evacuated with exhaust gasses to atmosphere and some of the exhaust gasses are trapped in the cylinder with the fresh fuel/air mixture. The lost fuel/air mixture causes reduced fuel efficiency and increased hydrocarbon emissions and the trapped exhaust gas causes less efficient combustion and reduced power output.

Various methods have been proposed for improving scavenging of two-stroke engines and therefore improving trapping efficiency to obtain power gains and reductions of fuel loss. One approach is "uniflow scavenging" which creates a long unidirectional flow of intake gasses from the intake port to the exhaust port which totally evacuates the burned gasses and does not reach the exhaust port before the exhaust port closes. Therefore, scavenging losses are reduced by the long distance between the ports.

Understandably, uniflow scavenging is well suited to long-stroke engines such as large-capacity, supercharged, marine diesel engines. In these engines, however, the scavenge loss is only air because fuel is injected after the exhaust port is closed. The exhaust port is typically located at the end of the cylinder and controlled with a cam-operated poppet valve.

A modified uniflow engine, referred to as a U-type uniflow engine, has two cylinders connected by a common combustion chamber. One cylinder has the scavenge port controlled by a timing edge of the piston and the other cylinder has the exhaust port controlled by the timing edge of the piston. The common combustion chamber provides the long distance between the scavenge and exhaust ports. This configuration also allows the exhaust port to be closed prior to the scavenge port without the use of additional parts such as valves because the scavenge port and the exhaust ports are controlled by separate pistons.

Several mechanical approaches have been proposed for U-type uniflow engines. One approach is to have separate crankshafts for the pistons. The crankshafts are coupled together by gears or chains. The cylinders are connected in a plane perpendicular to the rotational axes of the crankshafts. For example, see U.S. Pat. No. 1,470,752 which is expressly incorporated herein in its entirety by reference.

Another approach is to have one crankshaft with two connecting rods mounted on the same crank pin. The cylinders connected in a plane parallel to the rotational axis of the crankshaft. For example, see U.S. Pat. No. 2,342,900 which is expressly incorporated herein in its entirety by reference.

Yet another approach is to have one crankshaft with an arrangement of two connecting rods linked together. The cylinders are connected in a plane perpendicular to the rotational axis of the crankshaft. For example, see U.S. Pat. No. 2,048,243 which is expressly incorporated herein in its entirety by reference.

Yet another approach is to have one crankshaft with two pistons linked together by a solid U-shaped rod and an additional rod to link the U-shaped rod to the crankshaft. The cylinders are connected in a plane perpendicular to the rotational axis of the crankshaft. For example, see U.S. Pat. No. 2,048,243 which is expressly incorporated herein in its entirety by reference.

Yet another approach is to have one crankshaft and a one-piece forked connecting rod which connects the pistons to the crankshaft. The cylinders are connected in a plane perpendicular to the rotational axis of the crankshaft. For example, see U.S. Pat. Nos. 1,474,591 and 4,079,705 which are expressly incorporated herein in their entirety by reference.

Each of these mechanical approaches for U-type uniflow engines improve the efficiency of loop scavenged engines. However, they share problems which have prohibited them from being successfully used in mass production such as excessive reciprocating masses which cause excessive vibration and decreased reliability. Additionally, the engines require too many parts and are too complicated to manufacture and/or assemble. Furthermore, the engines with forked connecting rods are high displacement engines with long and heavy connecting rods and are very inefficient engines with maximum speeds of about 1500 rpm and modest outputs of about 9.3 hp/liter. Accordingly, there is a need in the art for an improved two-stroke, U-type uniflow engine which can be used to power a portable tool, has a reduced number of parts, has a relatively low level of vibrations, withstands speeds up to 1200 rpm with power outputs up to 40 hp/liter, and has increased reliability.

BRIEF SUMMARY OF THE INVENTION

The present invention provides a uniflow engine which overcomes at least some of the above-noted problems of the related art. According to the present invention the uniflow engine includes a cylinder block forming first and second cylinders and a common combustion chamber connecting the first and second cylinders. First and second pistons are mounted for reciprocal, linear movement within the first and second cylinders respectively. The engine also includes a crank shaft having a crank pin and a one-piece forked connecting rod connecting each of the first and second pistons to the crank pin. The connecting rod is elastically flexible to accommodate variations between a maximum distance between the wrist pins of the first and second pistons and a minimum distance between the wrist pins of the first and second pistons. The connecting rod is in a relaxed state between the maximum distance and the minimum distance. Preferably, the connecting rod is in the relaxed state about half-way between the maximum distance and the minimum distance. This is to minimize the flexing stress in the connecting rod and thus to increase operating life.

According to another aspect of the invention, the first and second cylinders are parallel and separated by a common central wall. The central wall has a slot for passage of the connecting rod therethrough and angled notches which correspond to maximum angles of the connecting rod in order to minimize the length of the slot. According to further aspects of the invention, the weight and length of the connecting rod are minimized and the difference between the maximum and minimum distances between the wrist pins is minimized in order to reduce vibrations and to increase engine output by maintaining high crankcase compression.

BRIEF DESCRIPTION OF THE SEVERAL VIEWS OF THE DRAWING

These and further features of the present invention will be apparent with reference to the following description and drawings, wherein.

DETAILED DESCRIPTION OF THE INVENTION

Figure 1:
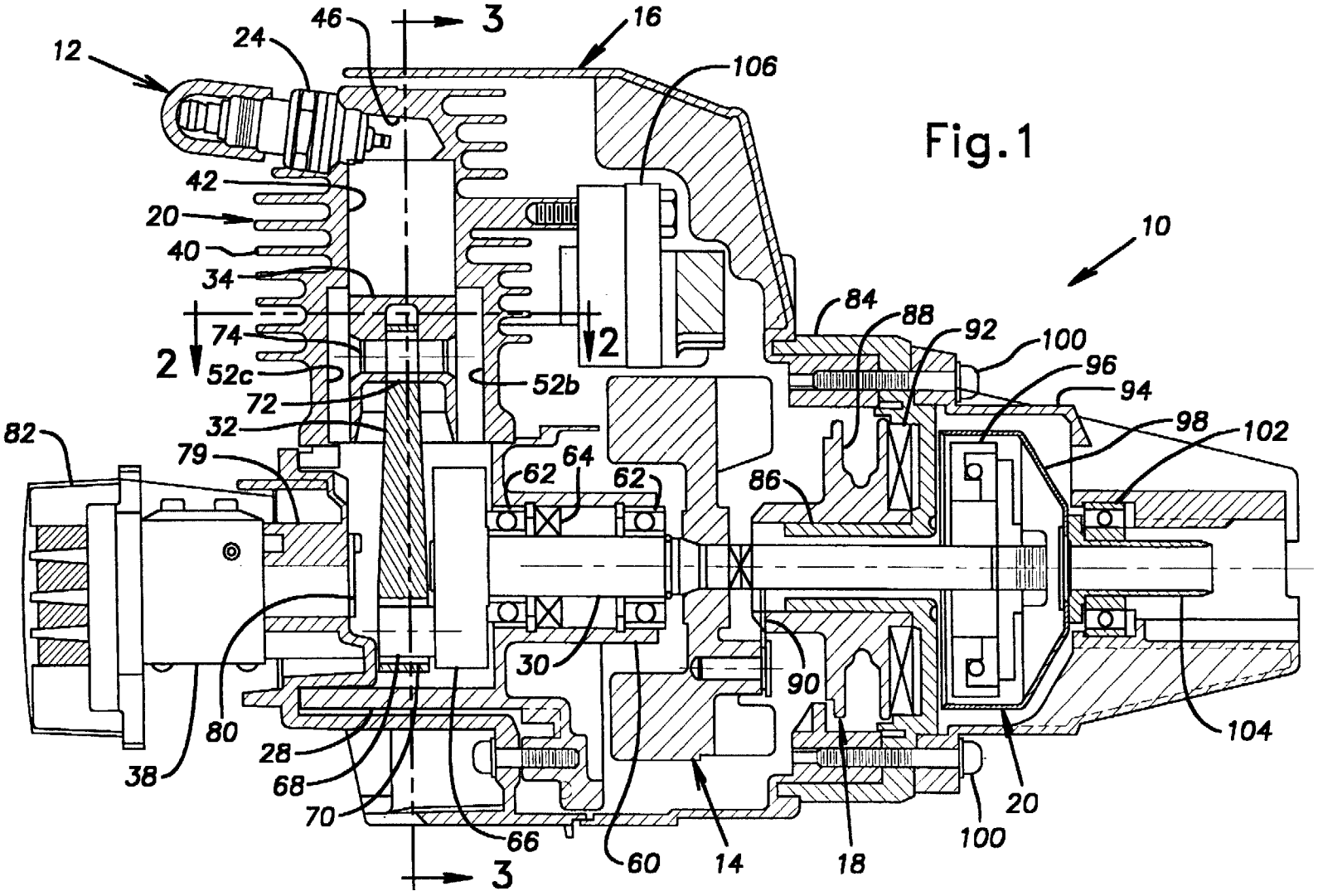
FIG. 1 is a side elevational view, in cross-section, of a power head for a portable tool according to the present invention.
Figure 2:
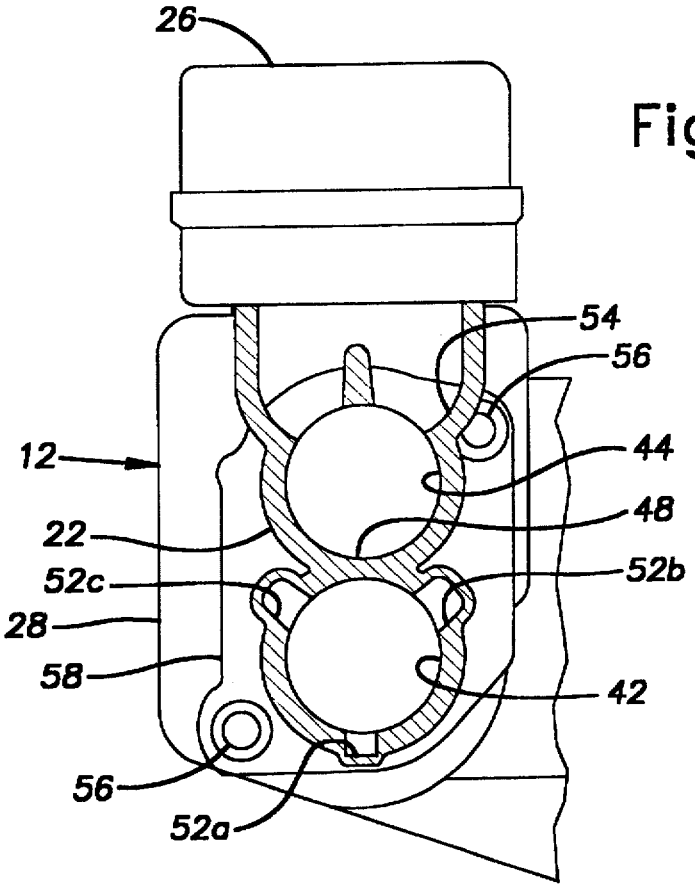
FIG. 2 is a plan view, partially in cross-section, taken along line 2—2 of FIG. 1 with pistons removed for clarity.
Figure 3:
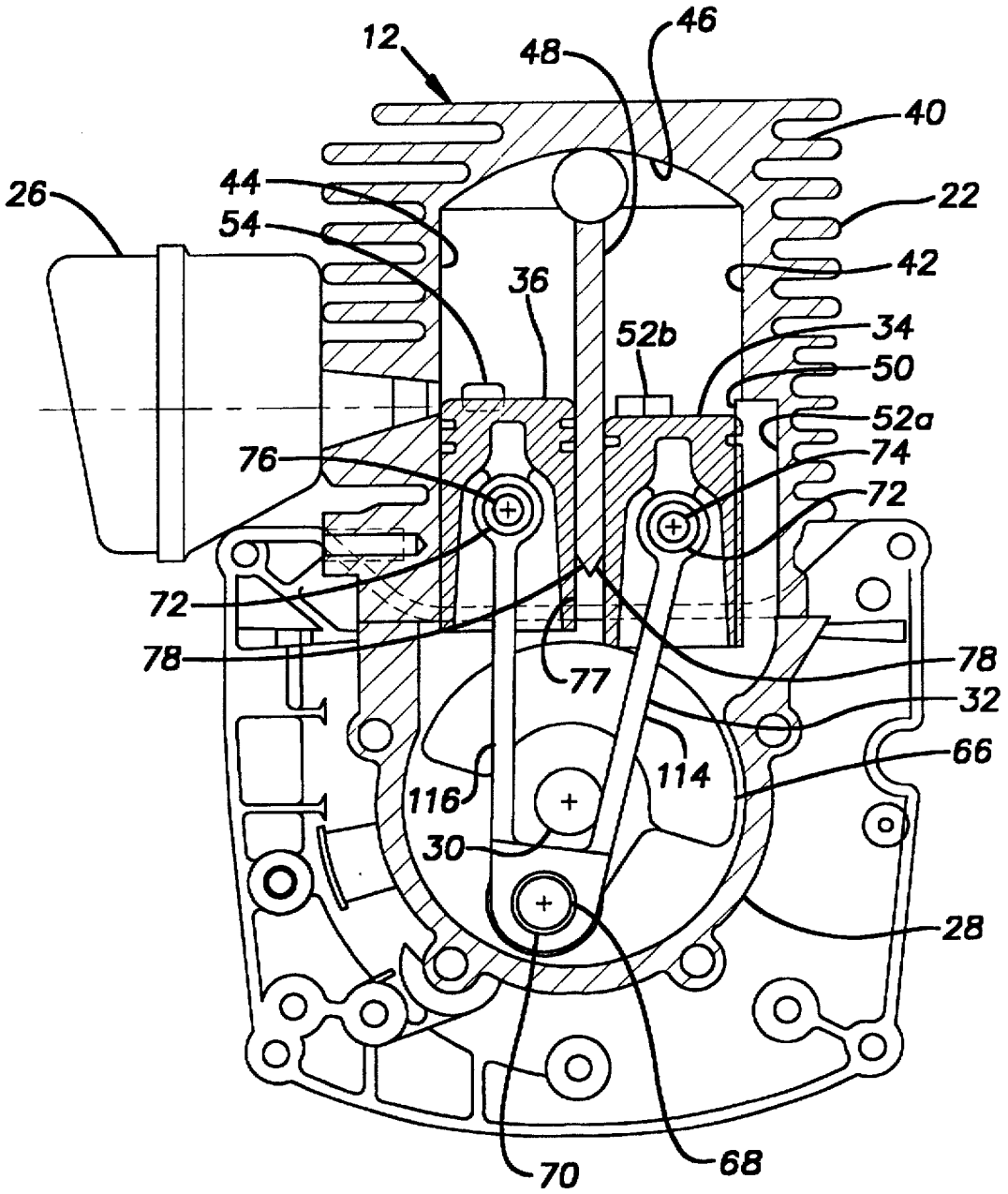
FIG. 3 is an end elevational view, partially in cross-section, taken along line 3—3 of FIG. 1.

FIGS. 1–3 illustrate a powerhead 10 according to the present invention used to power portable tools such as those used in forestry, lawn, and garden applications. Such portable tools include chain saws, lawn mowers, leaf blowers and vacuums, trimmers, snow blowers, lawn edgers, hedge trimmers, and the like. The power head 10 includes an internal-combustion engine 12, a fan or flywheel 14, a main housing 16, a recoil-type starting system 18, and a centrifugal clutch assembly 20.

The internal-combustion engine 12 is a two-cycle, two-cylinder, uniflow-type engine which supplies rotary power. The engine 12 includes a cylinder block 22, a spark plug 24, a muffler 26, a crankcase 28, a crankshaft 30, connecting rod 32, first and second pistons 34, 36, and a carburetor 38. The cylinder block 22 includes a plurality of cooling fins 40 disposed around the circumference of the cylinder block 22 for cooling the engine 12. The cylinder block 22 includes "siamesed" first and second cylinders 42, 44 to form a uniflow-style engine. The first and second cylinders 42, 44 are connected at one end by a common combustion chamber 46. The sparkplug 24 is mounted to the cylinder block 22 and extends into the combustion chamber 46. The centerlines of the cylinders 42, 44 are substantially parallel and spaced apart in a plane perpendicular to the crankshaft 30. The cylinder block 22 is preferably cast as a single, integral piece with a central wall 48 separating the first and second cylinders 42, 44. The cylinder block 22 is preferably fabricated from aluminum alloy.

The first or scavenge cylinder 42 has a plurality of scavenge ports or windows 50 formed by a plurality of axially-extending transfer channels **52*a*, 52*b*, and 52*c* defined along the inside diameter of the first cylinder 42 (best shown in FIGS. 2 and 3). The transfer channels 52*a*, 52*b*, and 52*c* are circumferentially spaced apart about the diameter of the first cylinder 42. The upper edge of the first or scavenge piston 34 exposes a top portion of the transfer channels 52*a*, 52*b*, 52*c* to form or open the scavenge windows 50 near the bottom of the piston stroke and covers the top portion of the transfer channels 52*a*, 52*b*, and 52*c* to close the scavenge windows 50 near the top of the piston stroke. The transfer channels 52*a*, 52*b*, and 52*c* are substantially parallel with the centerline of the first cylinder 42 and extend to the open end of the cylinder block 22. One of the transfer channels 52*a* is an auxiliary transfer channel and is smaller than the other transfer channels 52*b*, 52*c* which are primary transfer channels. The auxiliary transfer channel 52*a* produces a swirl within the scavenge cylinder 42 which improves scavenging during operation of the engine 12. This auxiliary port 52*a* also opens slightly later than the main ports 52*b*, 52*c***.

The second or exhaust cylinder 44 has an exhaust port or window 54. The upper edge of the second or exhaust piston 36 opens the exhaust window 54 near the bottom of the piston stroke and closes the exhaust window 54 near the top of the piston stroke. The muffler 26 is mounted to the side of the cylinder block 22 and is coupled with the exhaust window 54 so that the muffler 26 is in fluid flow communication with the exhaust cylinder 44. The muffler 26 receives exhaust gases from the exhaust cylinder 44 and expels them at a lower pressure and generally away from the operator of the portable tool.

The crankcase 28 is configured to support the crankshaft 30 and to generally close the open end of the cylinder block 22. The cylinder block 22 is connected to the crankcase 28 by bolts 56 extending through holes in a flange 58 of the cylinder block 22. The crankcase 28 includes a generally tubular-shaped bearing mount 60 at one end and has an opening at end opposite the bearing mount 60. The crankcase 28 is preferably formed from magnesium or other suitable light weight material.

The crankshaft 30 outwardly extends from the crankcase 28 and is supported for rotation by a pair of bearings 62 in a cantilevered manner. The bearings 62, along with a seal 64, are mounted within the bearing mount 60 of the crankcase 28. A counterweight 66 is attached to an end of the crankshaft 30 within the crankcase 28. An eccentric crank pin 68 is attached to the counterweight 66. The crank pin 68 extends from the counterweight 66 parallel and offset from the axis of rotation of the crankshaft 30.

The connecting rod 32, which is discussed in more detail below, is "V-shaped" or "forked" and connects the crank pin 68 with the first and second pistons 34, 36 located in the first or scavenging and second or exhaust cylinders 42, 44 respectively (best shown in FIG. 3). The connecting rod 32 is mounted to the crank pin 68 through a bearing 70 carried by the connecting rod 32 and receiving the crank pin 68. The connecting rod 32 is mounted to the pistons 34, 36 through bearings 72 carried by the connecting rod 32 and receiving or wrist pins 74, 76 of the first and second pistons 34, 36 respectively.

The rotational axis of the crankshaft 30 is offset from the centerline of the cylinder block 22 toward the exhaust cylinder 44 (best shown in FIG. 3). This offset results in a kinematic phenomenon wherein the travel of the pistons 34, 46 is longer than the stroke of the crankshaft 30. The offset also results in a considerable advance of the exhaust piston 36 ahead of the scavenge piston 34 so that an increased area of the exhaust window 54 is opened before the scavenge windows 50 are opened. This increases the trapping efficiency and reduces the release of unburned hydrocarbons to the atmosphere.

The offset, however, produces severe connecting rod 32 angles which results in increased friction forces of the pistons 34, 36 against the cylinders 42, 44. The most severe angles occur at about 80 degrees before and after the crank pin 68 is at top dead center. As will be discussed in more detail below, the design of the connecting rod 32 creates a spring force which is opposite to the direction of the thrust force of one of the pistons 34, 36 to reduce the magnitude of the net thrust force and therefore reduce engine internal friction. The offset also causes an undesirable slot 77 in the central wall 48 for the connecting rod 32 to pass therethrough. The length of the slot 77 is minimized by providing opposed angled notches 78 at the lower end of the central wall 48 which correspond to the severest angles of the connecting rod 32.

Figure 7:
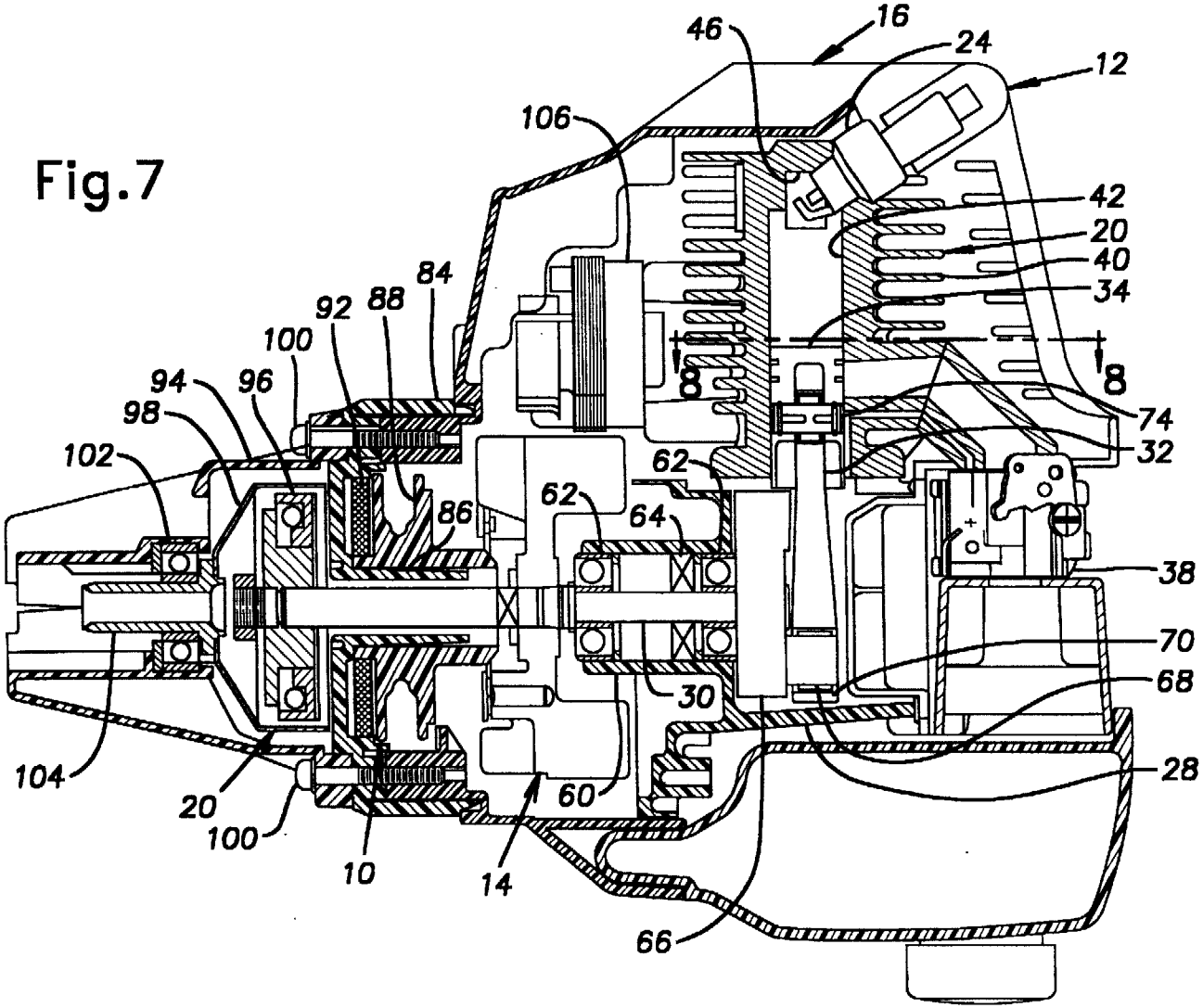
FIG. 7 is a side elevational view, in cross-section, of a second embodiment of a power head for a portable tool according to the present invention.
Figure 8:
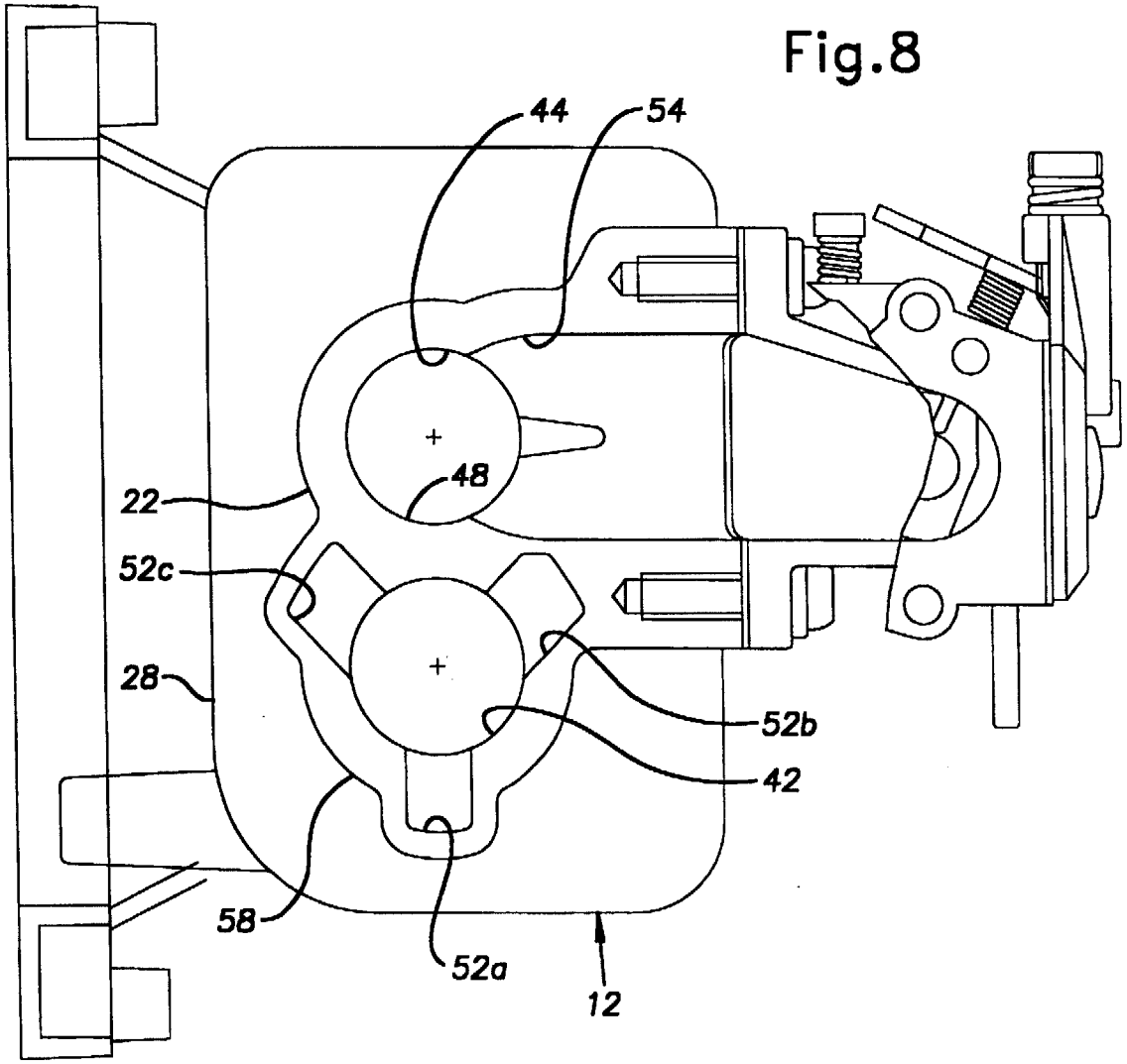
FIG. 8 is an enlarged plan view, partially in cross-section, taken along line 8—8 of FIG. 7 with some components removed for clarity.

A reed block 79 is mounted to the crankcase 28 and closes the opening at the end of the crankcase 28 opposite the bearing mount 60. The reed block 79 includes a reed valve 80 which opens and closes according to pressure within the crankcase 28. The reed block 79 supports the carburetor 38 which mixes air drawn through an air filter 82 with a fuel and oil mixture from a fuel tank (not shown). The carburetor 38 provides the resulting charge to the crankcase 28 when the reed valve 80 opens. Alternatively, the engine 12 can be configured with a third port or window system, by replacing the reed block 79 with a plug and mounting the carburetor 38 to the cylinder block 22 and coupling the carburetor 38 to an intake port at the lower portion of one of the cylinders 42, 44 (shown in FIGS. 7 and 8).

The flywheel 14 is mounted to the crankshaft 30 for rotation therewith outside and adjacent the crankcase 28. The flywheel 14 is of conventional design and includes a plurality of centrifugal impeller blades. The main housing forms a volute so that the flywheel 14 draws in cooling air and blows it across the cooling fins 40 of the cylinder block 22 to take away heat generated by combustion.

The recoil-type starting system 18 is located adjacent the flywheel 14 and includes a starter housing 84 attached to the main housing 16. The starter housing 18 has a tubular-shaped mounting portion 86 extending about the crankshaft 30 adjacent the flywheel 14. A starter pulley 88 is rotatably supported by and slidably mounted on the mounting portion 86 of the starter housing 84. The starter pulley 88 is coupled to the crankshaft 30 of the engine with a spring biased pawl or dog 90 so that rotating the starter pulley 88 turns the crankshaft 30 when the engine 12 is at rest but disengages from the crankshaft 30 when the engine 12 is running. A starter cord (not shown) extends through an opening in the starter housing 84, wraps around the starter pulley 88, and connects a starter handle (not shown) to the starter pulley 88. In a conventional manner, the operator pulls the starter handle to start the engine 12. The starter pulley 88 has operatively associated therewith a rewind spring element 92 which recoils the cord onto the starter pulley 88.

The centrifugal clutch assembly 20 is located adjacent the starting mechanism 18 and is coupled to the free end of the cantilevered crankshaft 30. The clutch assembly 20 includes a clutch housing 94, clutch shoes 96, and a clutch drum 98. The clutch housing 94 is mounted to the main housing 16 with screws 100 with the starter housing 84 secured therebetween. The clutch shoes 96 are connected to the crankshaft 30 for rotation therewith and are biased by springs to a retracted position in which they do not engage the clutch drum 98. At some rotational speed of the crankshaft 30, which is greater than idle speed, the clutch shoes 96 are moved radially outward to an extended position in which they engage the clutch drum 98 and rotate the clutch drum 89 therewith. The bias of the springs is overcome by centrifugal forces generated by rotation of the crankshaft 30. The clutch drum is rotatably supported within the clutch housing 94 by a bearing 102 and has a coupling 104 for connecting a drive shaft (not shown) of the portable tool.

An ignition module 106 is mounted to the cylinder block 22 in close proximity to the flywheel 14. A magnet on the flywheel 14 excites the ignition module 106 to produce an electrical charge that is transmitted to the spark plug 24. The spark plug 24 produces a spark in the combustion chamber 46 in response to the electrical charge and ignites fuel/air mixture located within the combustion chamber 46.

The first piston 34 is mounted for reciprocating, translational motion within the scavenge cylinder 42. Similarly, the second piston 36 is mounted for reciprocating, translational motion within the exhaust cylinder 44. The distance between the pins 74, 76 of the pistons 34, 36 varies during a cycle wherein a minimum distance is obtained when the crank pin 68 is at about top dead center (TDC) and at about bottom dead center (BDC) and a maximum distance is obtained when the crank pin 68 is at about 80 degrees before and after TDC. The pistons 34, 36 are connected to the crankshaft 30 by the one-piece connecting rod 32 as discussed above. Therefore, the connecting rod 32 must elastically flex as the spacing between the piston pins 74, 76 varies from the maximum distance to the minimum distance as the pistons 34, 36 cycle within the cylinders 42, 44.

Figure 4:
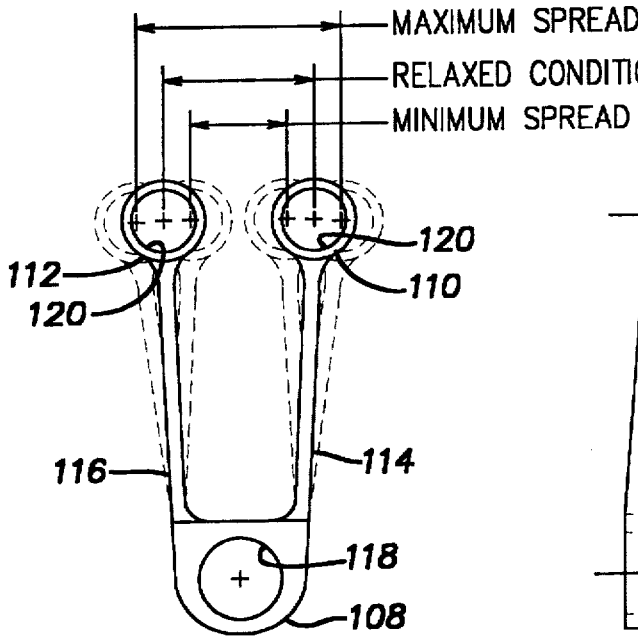
FIG. 4 is a front elevational view of a flexing connecting rod for a two-stroke, U-type uniflow engine of the power head of FIG. 1.
Figure 5:
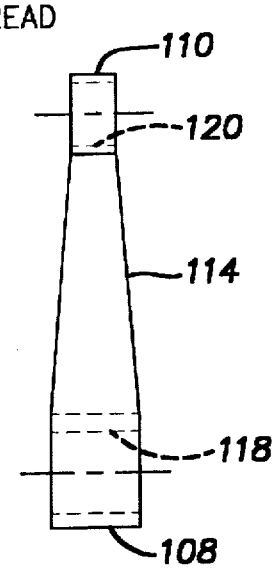
FIG. 5 is a side elevational view of the flexing connecting rod of FIG. 4.

As best shown in FIGS. 4 and 5, the connecting rod 32 has a generally cylindrically-shaped crankshaft boss 108, cylindrically-shaped first and second piston bosses 110, 112, and first and second rod arms 114, 116 connecting the piston bosses 110, 112 to the crankshaft boss 108. The crankshaft boss 108 forms an opening 118 which is sized for receiving the bearing 70 therein with a press-fit. The piston bosses 110, 112 also each form an opening 120 which is sized for receiving one of the bearings 72 therein with a press-fit. The rod arms 114, 116 are approximately tangent to the opening 118 in the crankshaft boss 108 so that the required size of the slot 77 in the cylinder block 22 is minimized. The rod arms 114, 116 are designed to support the piston force yet they are sufficiently resilient to elastically flex when the spacing between the piston pins 74, 76 varies from the maximum distance to the minimum distance. The crankshaft boss 108 has a width in the direction parallel to the opening 118 which is larger than the width of the piston bosses 110, 112 in the direction parallel to the openings 120.

The rod arms 114, 116 are generally rectangularly-shaped in cross section with the width in the direction parallel to the center line of the openings 118, 120 larger than the width in the direction perpendicular to the centerline of the openings 118, 120. The width of the rod arms 114, 116, in the direction parallel to the center line of the openings 118, 120, decreases from the width of the crankshaft boss 108 to the width of the piston bosses 110, 112. Also the arms are tapered to make the flexing stresses along the member equal.

It should be noted that the rod arms 114, 116 are laterally located equal distances from the centerline of the crankshaft boss 108. Therefore, the connecting rod 32 is symmetrical about a central plane containing the centerline of the crankshaft boss 108. This configuration of the connecting rod 32 is for the illustrated engine 12 which has the two pistons 34, 36 of generally equal size. When different sized pistons are utilized, the rod arms 114, 116 are laterally moved towards or away from the centerline of the crankshaft boss (crank pin) 108 to balance the momentum produced by the action of the pressure of combustion gasses in the unequal sized cylinders. Therefore, the connecting rod would not be symmetrical about the central plane containing the centerline of the crankshaft boss. This condition avoids unwanted flexion of the rod around the crank pin.

The connecting rod 32 is preferably formed from aluminum alloys or other suitable lightweight and strong material such as titanium. The connecting rod 32 is also sized and shaped to be as small and lightweight as possible in order to reduce vibrations and to be as short as possible to improve crankcase compression and therefore engine output. The connecting rod 32 should function within elastic limits yet have an infinite fatigue life. These characteristics of the connecting rod 32 are obtained by designing the connecting rod 32 to absorb the variation in distance between the piston pins 74, 76 with bilateral flexure. The bilateral flexure reduces stresses in the connecting arms 114, 116 and also reduces overall friction forces of the pistons 34, 36 against the cylinders 42, 44 as noted above. This allows the connecting rod 32 to have an increased total flexure/length ratio. Additionally, the engine 12 is preferably designed with a stroke/bore ratio which minimizes the difference between the maximum and minimum distances between the piston pins 74, 76.

As best shown in FIG. 4, bilateral flexure of the rod arms 114, 116 is obtained by dimensioning the connecting rod 32 so that the free state or relaxed condition of the connecting rod 32 is between the maximum spread required and the minimum spread required. Preferably the relaxed condition is substantially half-way between the maximum and minimum spreads. Dimensioning the connecting rod 32 in this manner minimizes the maximum deflection of either of the rod arms 114, 116. For example, if the difference between the maximum and minimum spreads is 0.8 mm, the maximum deflection of either rod arm 114, 116 in a single direction is 0.2 mm if the relaxed condition is half-way between the maximum and minimum spreads.

The preferred steps for designing the connecting rod 32 with the minimum weight and size which can manage the existing forces are as follows. A beam shape for the connecting rod 32 is selected to provide maximum column strength and minimum flexing stresses. The required column strength of the rod arms 114, 116 is calculated for maximum axial force over the piston pins 74, 76. Preferably, no more than 50% of the critical value is allowed. Note that the maximum piston pin 74, 76 spread is a fixed parameter given by the bore sizes and the stroke of the engine 12. Therefore, the shortest allowable length for the connecting rod 32 can be calculated by balancing the stress at maximum axial force (gas pressure) and maximum inward flexure of the rod arms 114, 116 with the stress at no axial force and maximum outward flexure of the rod arms 114, 116. Note that an adjustment must be made if the stress level obtained exceeds the level of stress required for infinite fatigue life for a given length and material. Preferably, other design considerations used are smooth transition lines, no stresses above 50% of the yield strength of the material, and flawless material structure.

Figure 6A:
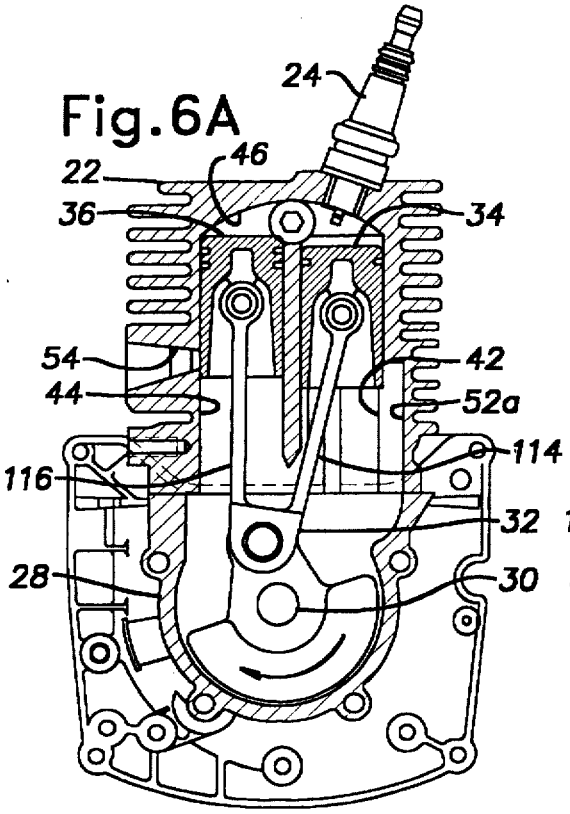
FIGS. 6A to 6H are cross-sectional views similar to FIG. 3 diagrammatically showing the two-stroke, U-type uniflow engine of the power head of FIG. 1 during progressive stages of operation.
Figure 6B:
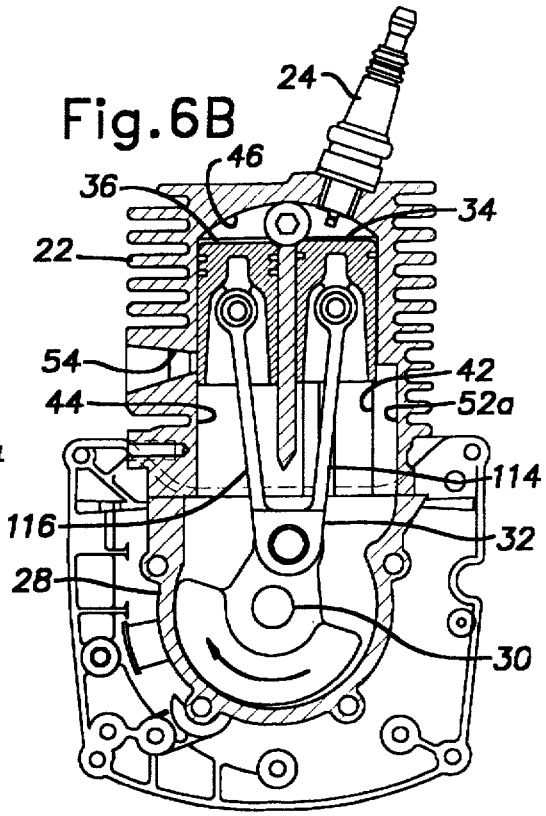

FIGS. 6A to 6H show a sequence of operation of the engine 12. FIG. 6A shows the exhaust piston 36 as it reaches a maximum upper position (MUP) with the scavenge piston 34. FIG. 6B shows the exhaust piston 36 descending and the scavenge piston 34 as it reaches a MUP. Note that the exhaust piston 36 reaches the MUP just prior to TDC and the scavenge piston 34 reaches the MUP just after TDC due to the offset of the crankshaft 30 and the cylinders 42, 44. The rod arms 114, 116 of the connecting rod 32 are at the minimum spread at about TDC.

Compressed gases within the combustion chamber 46 are ignited and the expansion process begins. Both pistons 34, 36 descend and continue to rotate the crankshaft 30 in a clockwise direction (as viewed in FIGS. 6A–6H). As the pistons 34, 36 descend, the rod arms 114, 116 flex outwardly until the maximum spread is reached at about 80 degrees after TDC and then the rod arms 114, 116 begin to flex inwardly. Note that at about half-way between the minimum and maximum spreads, the rod arms 114, 116 pass through the relaxed condition.

Figure 6C:
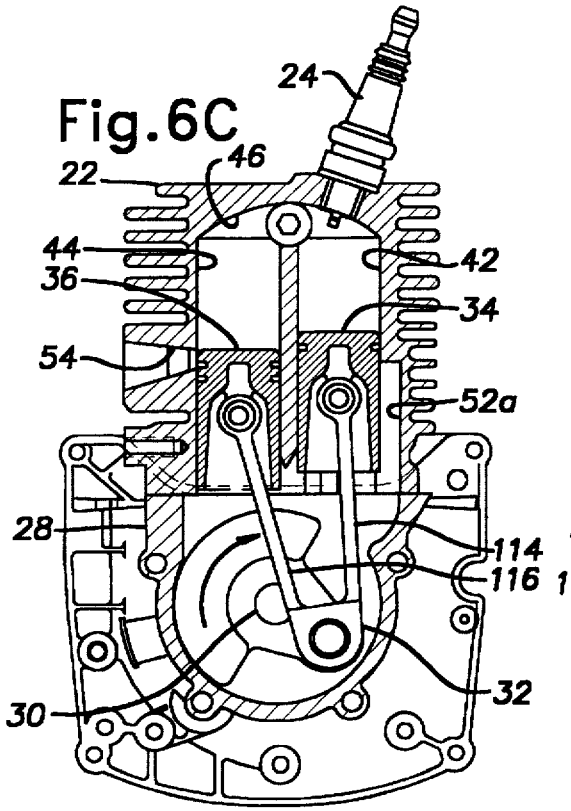
Figure 6D:
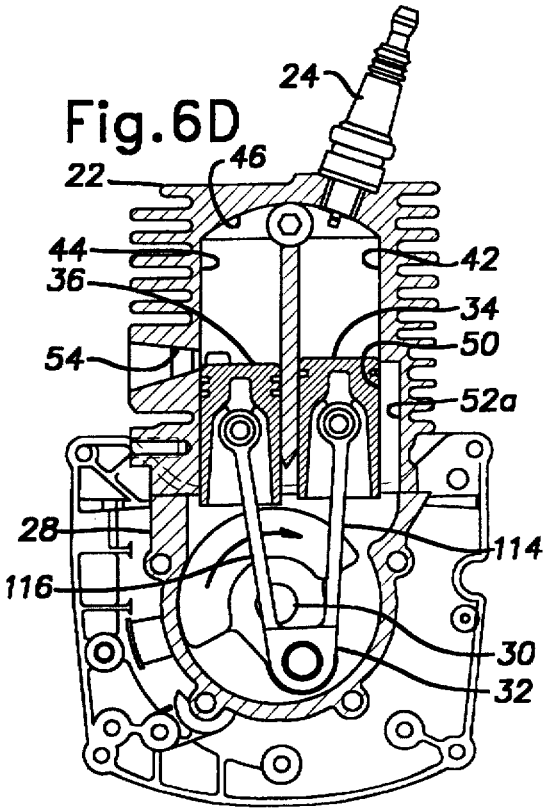

FIG. 6C shows the exhaust window 54 beginning to open as the top edge of the exhaust piston 36 descends past the exhaust window 54. With the exhaust window 54 open, burned gases exhaust from the cylinders 42, 44 to the muffler 26 through the exhaust window 54. FIG. 6D shows the scavenge windows 50 beginning to open as the top edge of the scavenge piston 34 descends past the top of the transfer channels **52*a*, 52*b*, 52*c*. Note that a major portion of the burned gases are exhausted to the muffler 26 before the scavenge windows 50 open. With the exhaust window 54 open, pressurized intake gasses from the crankcase 28 enter the scavenge cylinder 42 through the transfer channels 52*a*, 52*b*, 52*c*. The intake gasses pass into the scavenge cylinder 42, through the combustion chamber 46, and into the exhaust cylinder 44 to complete the evacuation of burned gases from the cylinders 42, 44 and to refill the cylinders 42, 44** with fresh fuel mixture.

Figure 6E:
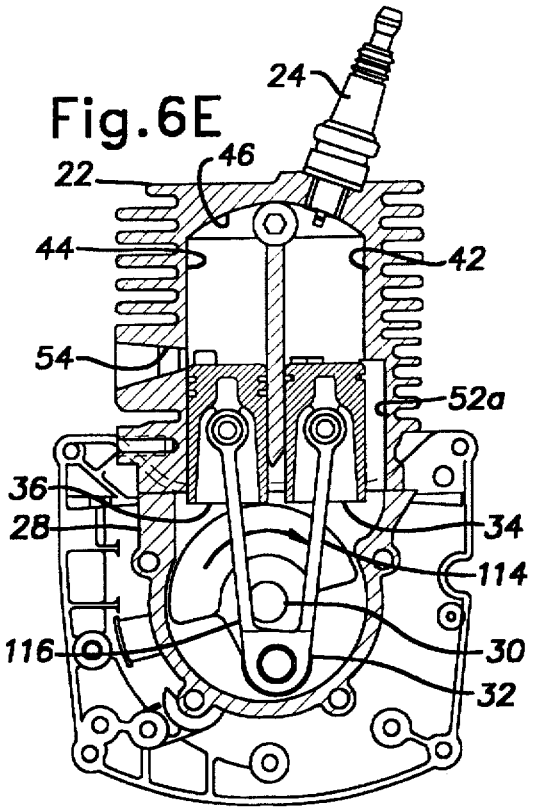
Figure 6F:
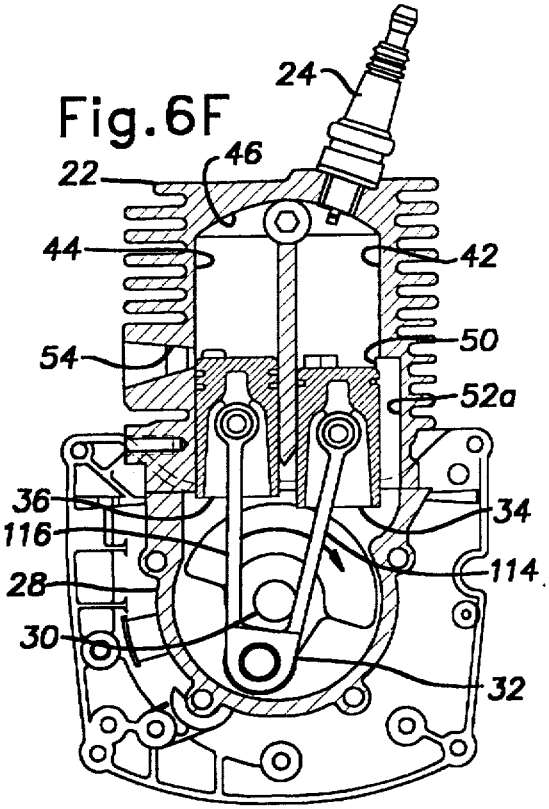

FIG. 6E shows the exhaust piston 36 as it reaches a maximum lower position (MLP) and the scavenge piston 34 descending. FIG. 6F shows the exhaust piston 36 rising to begin closing the exhaust window 54 and the scavenge piston 34 as it reaches a MLP. Note that the exhaust piston 36 reaches the MLP just prior to BDC and the scavenge piston 36 reaches a MUP just after BDC due to the offset of the crankshaft 30 and the cylinders 42, 44. The rod arms 114, 116 of the connecting rod 32 are at the minimum spread at about BDC. Note that at about half-way between the maximum and minimum spreads, the rod arms 114, 116 again passed through the relaxed condition.

Figure 6G:
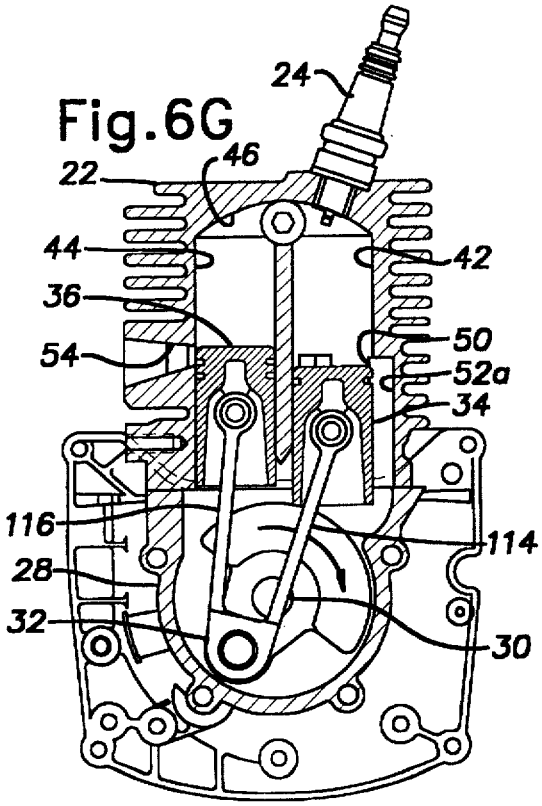
Figure 6H:
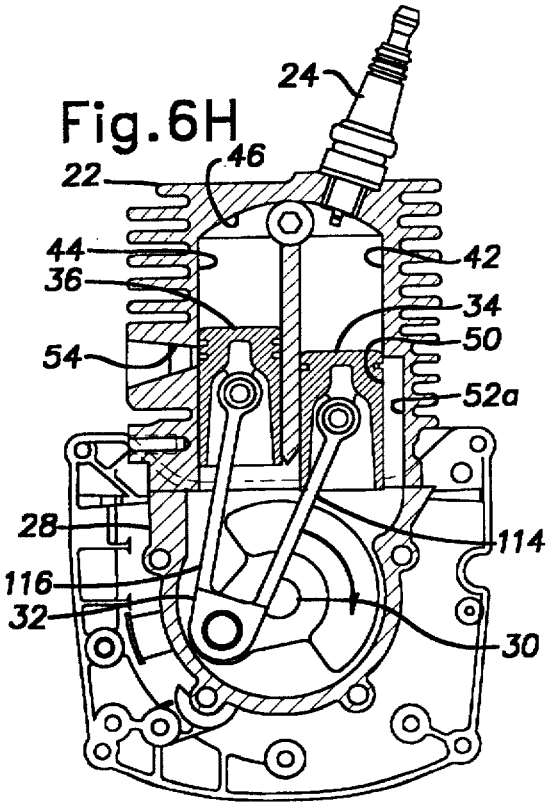

FIG. 6G shows the exhaust window 54 fully closed as the top edge of the exhaust piston 36 rises past the top of the exhaust window 54. Note that the scavenge windows 50 remain open after the exhaust window 54 is fully closed allowing more fresh fuel mixture to fill the cylinders 42, 44 and therefore improving trapping efficiency of the engine 12. FIG. 6H shows the scavenge windows 50 fully closed as the top edge of the scavenge piston 34 rises past the top of the transfer channels **52*a*, 52*b*, 52*c*. The compression process begins as both pistons 34, 36 continue to rise and compress the fresh fuel mixture in the combustion chamber 46. As the pistons 34, 36 rise, the rod arms 114, 116 flex outwardly until the maximum spread is reached at about 80 degrees before TDC and then the rod arms 114, 116 begin to flex inwardly. Note that at about half-way between the minimum and maximum spreads, the rod arms 114, 116** pass through the relaxed condition.

The exhaust piston 36 continues to rise until it reaches the MUP as shown in FIG. 6A. The rod arms 114, 116 of the connecting rod 32 are at the minimum spread at about TDC. Note that at about half-way between the maximum and minimum spreads, the rod arms 114, 116 again passed through the relaxed condition. The described sequence of events are repeated to continue rotating the crank shaft 30 until operation of the engine 12 is stopped. It can be seen from the above description that during one full rotation of the crankshaft 30, the connecting rod twice reaches the maximum spread and twice reaches the minimum spread, and therefore passes through the relaxed state four times.

Although particular embodiments of the invention have been described in detail, it will be understood that the invention is not limited correspondingly in scope, but includes all changes and modifications coming within the spirit and terms of the claims appended hereto.

What is claimed is:

1. A uniflow engine comprising:

a cylinder block forming first and second cylinders and a common combustion chamber connecting said first and second cylinders;

first and second pistons mounted for reciprocal, linear movement within said first and second cylinders respectively;

a crank shaft having a crank pin; and a one-piece forked connecting rod connecting each of said first and second pistons to said crank pin, wherein said connecting rod is elastically flexible to accommodate variations between a maximum distance between said first and second pistons and a minimum distance between said first and second pistons and said connecting rod is in a relaxed state between said maximum distance and said minimum distance.

2. The uniflow engine according to claim 1, wherein said connecting rod is in a relaxed state at a distance between said first and second pistons which is about half-way between said maximum distance and said minimum distance.

3. The uniflow engine according to claim 1, wherein said connecting rod comprises aluminum.

4. The uniflow engine according to claim 1, wherein said cylinders are substantially parallel and in a plane perpendicular to a rotational axis of said crankshaft, and said rotational axis of said crankshaft is offset from a centerline between said first and second cylinders.

5. The uniflow engine according to claim 4, wherein said first and second cylinders are separated by a common central wall and said central wall has a slot for passage of said connecting rod therethrough.

6. The uniflow engine according to claim 5, wherein an end of said central wall has angled notches which correspond to maximum angles of said connecting rod.

7. The uniflow engine according to claim 1, wherein said connecting rod has a crankshaft boss, first and second piston bosses, and first and second rod arms respectively connecting said first and second piston bosses with said crankshaft boss.

8. The uniflow engine according to claim 7, wherein said first and second rod arms are generally tangent to said crankshaft boss.

9. The uniflow engine according to claim 7, wherein said first and second rod arms have a rectangular cross-section.

10. A uniflow engine for a portable tool comprising:

a cylinder block forming first and second cylinders and a common combustion chamber connecting said first and second cylinders, said first and second cylinders being substantially parallel and separated by a common central wall;

first and second pistons mounted for reciprocal, linear movement within said first and second cylinders respectively;

a crank shaft having an eccentric crank pin and a rotational axis perpendicular to a plane of said first and second cylinders, said rotational axis being offset from said central wall between said first and second cylinders; and a connecting rod connecting each of said first and second pistons to said crank pin, wherein said central wall has a slot for passage of said connecting rod therethrough and angled notches which correspond to maximum angles of said connecting rod.

11. The uniflow engine according to claim 10, wherein said connecting rod is a one-piece forked connecting rod.

12. The uniflow engine according to claim 11, wherein said connecting rod is bilaterally flexible to accommodate variations between a maximum distance between said first and second pistons and a minimum distance between said first and second pistons.

13. The uniflow engine according to claim 12, wherein said connecting rod is in a relaxed state about half-way between said maximum distance and said minimum distance.

14. A method for reducing vibrations in a two-stroke, U-type uniflow engine, said method comprising the steps of:

reciprocating first and second pistons located within first and second cylinders respectively and connected to a common crank pin with a one-piece forked connecting rod; and bilaterally flexing the connecting rod to accommodate variations between a maximum distance between the first and second pistons and a minimum distance between the first and second pistons.

15. The method according to claim 14, further comprising the step of relaxing the connecting rod to a free state about half-way between the maximum distance and the minimum distance.

16. The method according to claim 14, further comprising the step of minimizing the weight of the connecting rod.

17. The method according to claim 14, wherein the step of minimizing the weight of the connecting rod includes forming the connecting rod from aluminum.

18. The method according to claim 14, wherein the step of minimizing the weight of the connecting rod includes minimizing the length of said connecting rod.

19. The method according to claim 14, further comprising the step of minimizing the length of the connecting rod.

20. The method according to claim 14, further comprising the step of minimizing the difference between the maximum distance and the minimum distance.

* * * * *